US005313932A

United States Patent [19]

Rieger et al.

[11] Patent Number: 5,313,932

[45] Date of Patent: May 24, 1994

[54] HOOD FOR FIREPLACE

[75] Inventors: Heinz H. Rieger, Toronto; Colin Adamson, Mississauga, both of Canada

[73] Assignee: 729819 Ontario Limited, Canada

[21] Appl. No.: 978,116

[22] Filed: Nov. 18, 1992

[30] Foreign Application Priority Data

Nov. 12, 1992 [CA] Canada ..... 2082791

[51] Int. Cl.[5] ..... F24B 1/188; F24B 1/189

[52] U.S. Cl. ..... 126/531; 126/515; 126/523; 126/528; 126/529; 126/307 A

[58] Field of Search ..... 126/531, 523, 528, 529, 126/512, 515, 77, 85 B, 307 A

[56] References Cited

U.S. PATENT DOCUMENTS

| | | | |
|---|---|---|---|
| 2,360,611 | 10/1944 | Leonard | 126/512 |
| 2,385,450 | 9/1945 | Kappel | 126/307 A X |
| 2,514,372 | 7/1950 | Cartter | 126/512 X |
| 3,601,117 | 8/1971 | Carson | 126/515 |
| 3,623,458 | 11/1971 | Block | 126/307 R X |
| 3,797,477 | 3/1974 | Ramey | 126/85 B X |
| 3,800,748 | 4/1974 | Schindler et al. | 126/85 B X |
| 4,013,059 | 3/1977 | Andrews | 126/531 X |
| 4,971,030 | 11/1990 | Thow et al. | 126/512 |
| 5,016,613 | 5/1991 | Maitland | 126/531 X |

*Primary Examiner*—Carl D. Price
*Attorney, Agent, or Firm*—Ladas & Parry

[57] ABSTRACT

A fireplace has a manifold positioned between a combustion chamber and a flue. The manifold has a pair of inlets to supply dilution air to the flue, one extending from a front face of the fireplace, and the other from a rearward location. A baffle extends across the outlet of the manifold to prevent direct communication between the combustion chamber and flue. The inlet at the front face enables the flow of dilution air to be checked with the fireplace installed without having to accomodate the full flow of dilution air. The baffle prevents downdrafts from adversely affecting the combustion in the combustion chamber.

55 Claims, 4 Drawing Sheets

HOOD FOR FIREPLACE

BACKGROUND OF THE INVENTION

The present invention relates to fireplaces. It is now quite common to provide a fireplace with a prefabricated combustion chamber that is intended to be connected to a flue. These fireplaces may either be inserted into existing conventional masonry fireplaces or may be installed and subsequently framed within the structure of the building. The heating and visual effects of the fireplace are conventionally supplied by means of a gas burner which simulates a conventional wood fire.

In order to retain the visual appeal of the fire, it is necessary for the combustion conditions to be carefully controlled and, more significantly, for safety purposes it is necessary to ensure that combustion products from the burner are conveyed to the flue. For this reason, it is usual to provide a supply of air to the flue to ensure that there is a constant flow of air along the flue that will induce the flow combustion products from the combustion chamber and into the flue and also to dilute the combustion products to reduce condensation in the flue.

Because of the importance of the air flow through the flue, it is now considered a requirement to provide for verification of the air flow after the unit has been installed. Conventionally, the balance flue has been provided from the front of the appliance but in order to maximize the viewing area of the combustion chamber, it has been proposed to provide the balance flue solely from the rear. However, where the appliance is to be located in a recess, this prevents testing of the balance flow to ensure that the flue has not been blocked.

SUMMARY OF THE INVENTION

It is therefore an object of the present invention to provide a fireplace in which the above disadvantages are obviated or mitigated.

According to the present invention, there is provided a fireplace having a combustion chamber with a front face to be directed into a room, an opening in said combustion chamber remote from the front face to allow egress of combustion products from the combustion chamber, and a manifold positioned outside the chamber and operable to connect the chamber to a flue. The manifold overlies the opening and has an exhaust outlet to direct combustion products into said flue, a baffle extending across the exhaust outlet and spaced from both the outlet and the opening to prevent direct passage of combustion products from the outlet to the flue. The manifold further includes a pair of inlets to supply dilution air to the flue. One of said inlets is connected to an aperture provided in the front face to receive dilution air therefrom and the other of said inlets receives balance air from a location remote from said front face.

In general terms, therefore, the manifold splits the balance flow between an aperture provided in the front face of the fireplace and a remote location. In this manner, it is possible to detect the presence of the balance flow from the front of the fireplace but at the same time it is not necessary to provide an aperture large enough to accomodate the requisite flow rate of the dilution air. Thus, the viewing area of the fireplace is maximized.

It is preferred that the inlet remote from the front face receives the balance air from a location lower than the aperture. This ensures that if a reverse flow occurs in the flue as may happen with a backdraft, then the flow will be accommodated through the aperture initially, thereby giving early warning of such a condition.

BRIEF DESCRIPTION OF THE DRAWING

An embodiment of the invention will now be described by way of example only with reference to the accompanying drawings, in which.

DESCRIPTION OF THE PREFERRED EMBODIMENT(S)

Figure 1:
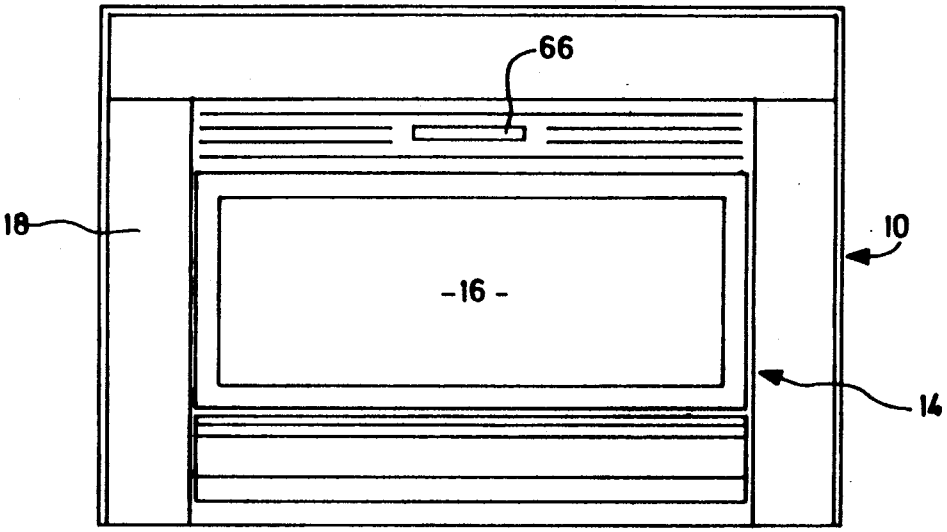
FIG. 1 is a front elevation of a fireplace.
Figure 2:
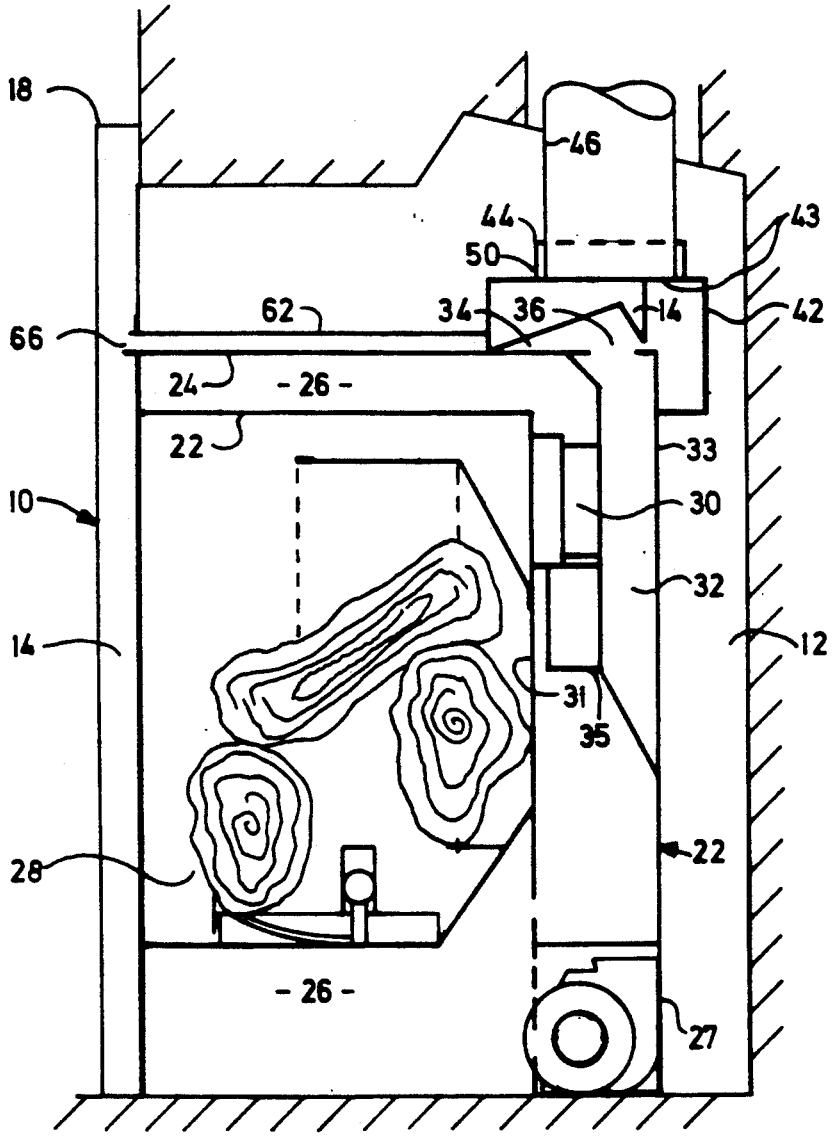
FIG. 2 is a side view of the fireplace shown in FIG. 1.

Referring therefore to FIGS. 1 and 2, a fireplace 10 is located within a cavity 12 defined by a conventional masonry fireplace. As such, the fireplace 10 is conventionally known as an insert but it will be appreciated that the fireplace could equally be a prefabricated fireplace incorporated within the structure of the house.

The fireplace 10 has a front face 14 that is directed toward a room and includes a window 16 to allow viewing of the combustion process. A frame 18 extends around the front face to cover the periphery of the cavity 12.

The fireplace 10 includes a housing generally indicated at 20 and having an inner firebox 22 serving as a combustion chamber and an outer box 24. The boxes 22,24 are spaced from one another to provide an air passage 26 around the firebox 22 to allow air from the room to be heated as it passes through the passage and returned to the room. A fan 27 is provided to assist circulation of air through the passage 26.

A burner assembly 28 is located within the firebox 22 and provides heat as well as simulating an open fire. The burner assembly 28 and its associated controls is conventional in nature and will not be described further.

A pair of circular ducts 30 extend from apertures in the rear wall 31 of firebox 22 to a secondary heat exchanger 32 located in the passage 26. The secondary heat exchanger 32 extends laterally across the rear wall 33 of outer box 24 and extends upwardly to the top panel 34 of box 24. Fins 35 direct air in the passage past the heat exchanger 32 and improve heat transfer between the combustion products and the air.

A slot 36 is provided in the top panel 34 of box 24 and is covered by a manifold 42 which is mounted on the top panel 34. The ducts 30, heat exchanger 32 and slot 36 thus provide an exhaust duct extending from the combustion chamber to the manifold. The manifold 42 includes an outlet 43 surrounded by an upstanding collar 44 that is connected to a rigid or flexible flue 46 located within the normal chimney structure. Combustion products from burner 28 thus pass through ducts 30, into the heat exchanger 32, and through slot 36 for egress through flue 46.

Figure 3:
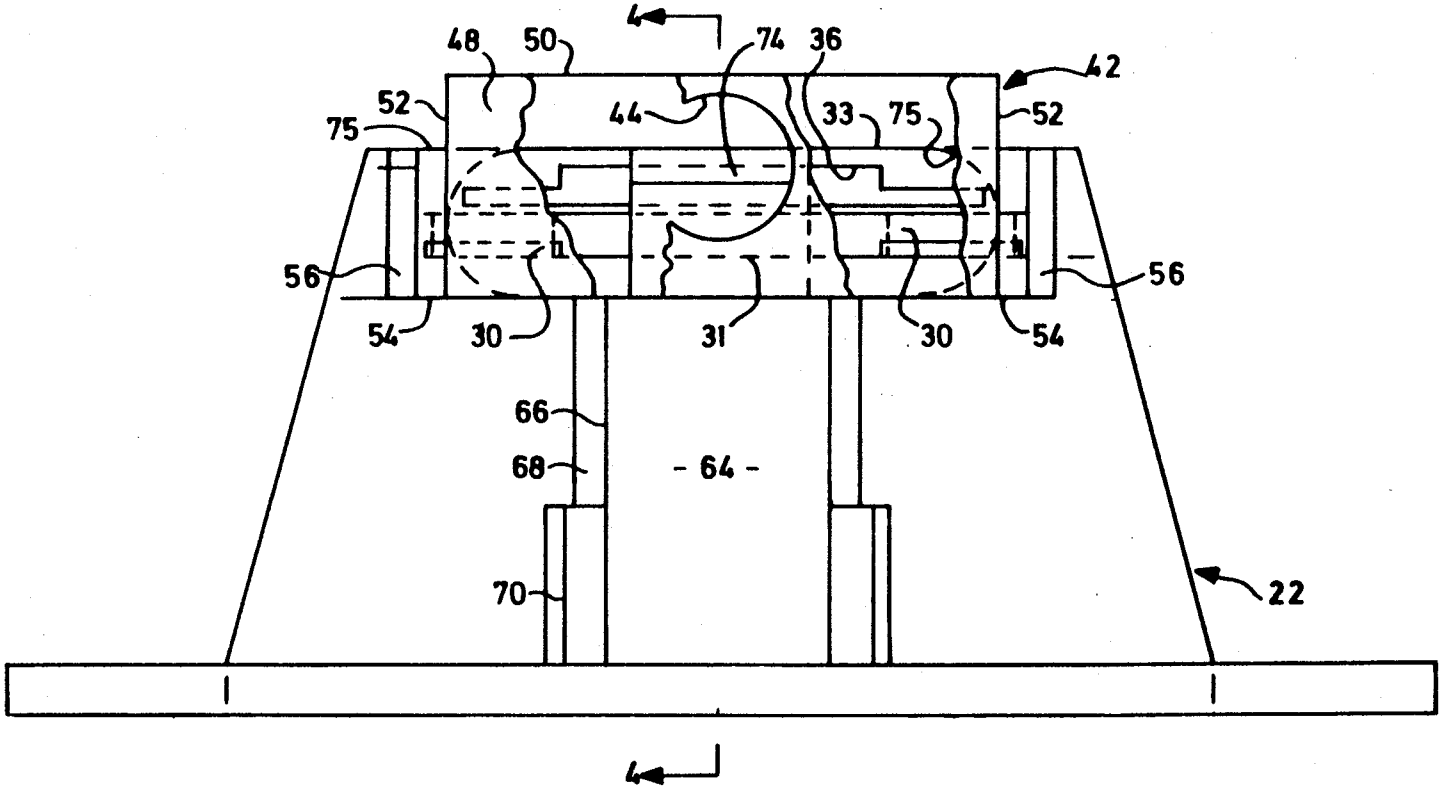
FIG. 3 is a plan view of the fireplace shown in FIG. 2.
Figure 4:
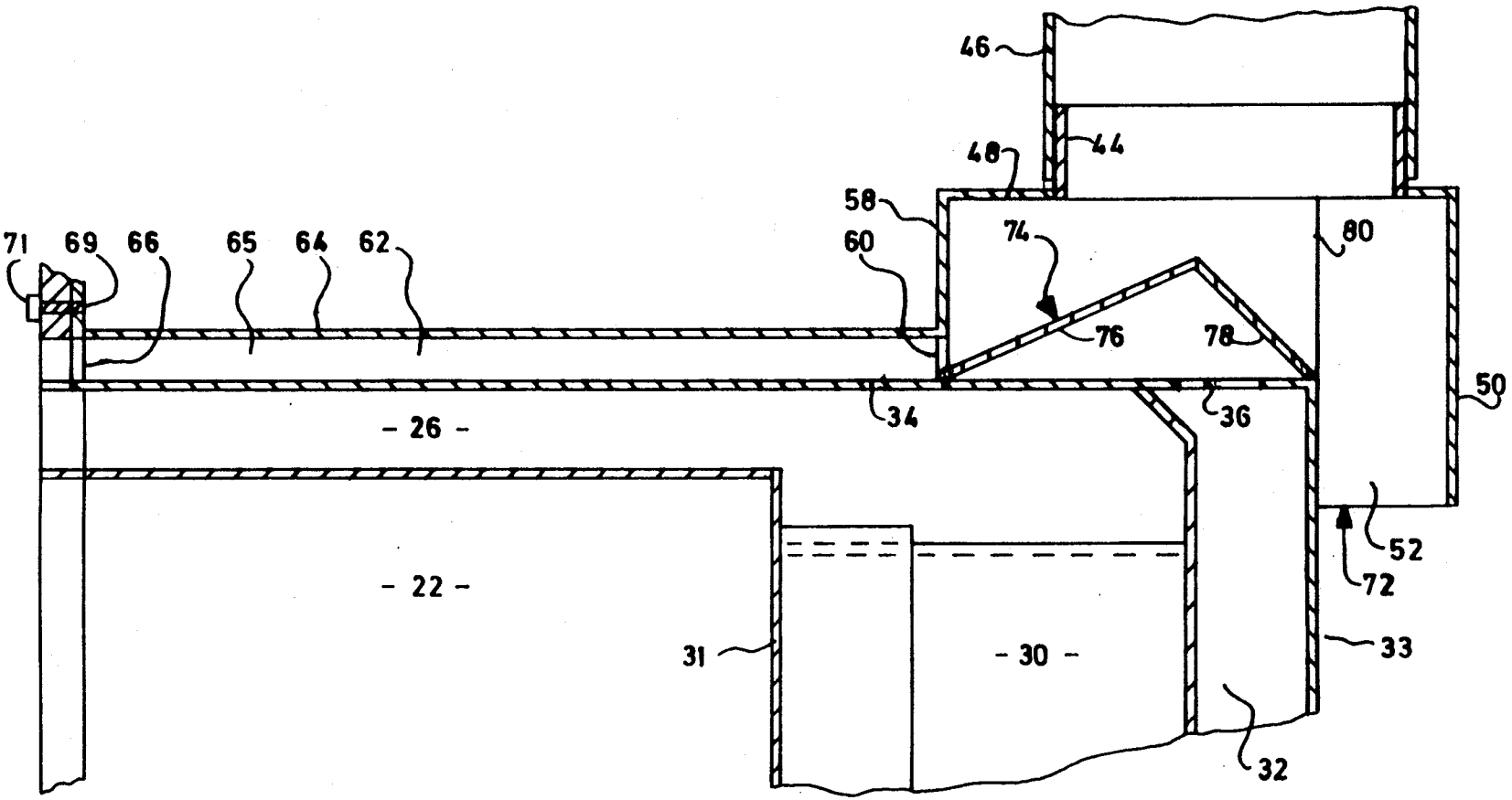
FIG. 4 is a view on the line 4—4 of FIG. 3.

As can best be seen in FIGS. 3 and 4, the manifold 42 includes a top plate 48 to which the collar 44 is connected. The top plate 48 extends rearwardly beyond the rear panel 33 of the box 24 and is connected along its rear edge to a back plate 50. The back plate 50 projects downwardly beyond the top panel 34 and is spaced from the rear wall 33 of the box 24. End plates 52 extend from the lateral edges of the top plate 48 and back plate 50 to the outer box 24. Each of the end plates 52 includes a laterally extending flange 54 that overlies the top panel 33 and is slidably received within brackets 56. A front plate 58 is connected to the front edge of the top plate 48 and extends downwardly to engage the top panel 34.

A central portion of the front plate 58 is notched as indicated at 60 and a rectangular duct 62 is connected to the front plate 58 so as to surround the notch 60. The rectangular duct 62 has a top wall 64 and side walls 65 which terminate in laterally extending flanges 68 to overlie corresponding portions of the top panel 34. The flanges 68 are slidably received in brackets 70 to hold the side walls 65 in close contact with the top panel 34 and allow the bottom wall of the duct 62 to be constituted by the panel 34.

The duct 62 is aligned with an aperture 66 provided in the front face 14 above the window 16. A seal is provided between the duct 62 and the aperture 66 by means of an upturned web 69 formed at the forward end of the top 64 and secured by a screw 71. The duct 62 thus provides a communication between the aperture 66 and the notch 60 to allow air to flow along the duct and into the interior of the manifold 42. It will also be observed that the lower edge of the rear panels 50 and side panels 52 are free so that air can also flow into the manifold through an opening indicated at 72. Air flowing through the duct 62 and through an opening 72 can thus introduce the dilution air into the flue 46 and ensure a constant updraft to extract combustion products from the firebox 22. Make-up air is supplied to the recess 12 by openings in the outer box 24 or slots in the frame 18.

A baffle 74 is located within the manifold and extends partially across the outlet 43 to prevent direct communication between the slot 36 and outlet 43. The baffle 74 includes a pair of oppositely inclined surfaces 76,78 with the forwardly inclined surface 76 extending to the notch 60 adjacent the top panel 34. The rearwardly inclined surface 78 extends to the intersection of the top panel 34 and rear wall 33.

The baffle 74 extends laterally beyond the outlet 43 and is supported by a pair of brackets 80 depending from the top plate 48. Combustion products are thus forced to flow laterally outwardly around the ends of the baffle 74 and then laterally inwardly to the outlet 43. To assist circulation, semicircular end plates 75 are located at the outer ends of the manifold 42.

It will also be noted from FIG. 4 that in cross-section, the baffle 74 is asymmetrical with the surface 78 inclined at a steeper angle and of greater length than the surface 76. In practice, it has been found that a baffle in which the included angle between the surfaces 76 and 78 is 120 with the surface 76 inclined at 25 to the horizontal has been found effective. Of course, variations in these angles may be found to produce satisfactory results.

In operation, the manifold 42 is connected to the flue 46 prior to insertion of the fireplace 10 into the cavity 12. The fireplace 10 is then slid into the cavity 12 and the flanges 68 and 54 slid into the brackets 70 and 56 respectively to secure the manifold and flue to the fireplace. The manifold is then secured by means of the screw 71 so that the manifold is securely located on the top plate 40. Once installed, an air flow is generated through the flue 46 which is accommodated by air flowing through the opening 72 and through the aperture 66. The presence of an air flow through the duct 62 can be tested by the passage of smoke from a match or candle which indicates that a satisfactory updraft is present in the flue 46. Upon ignition of the burner 28, the combustion byproducts flow through the slots 36 and into the manifold 42. There they pass around the baffle 74 and are entrained with the updraft along the flue.

If a downdraft occurs in the flue due to adverse atmospheric conditions, the downdraft produced will impinge on the upper surfaces of the baffle 74 and be directed partly through the opening 72 and partly along the duct 62. The baffle 74 inhibits downdraft into the firebox 22 to prevent adverse combustion conditions within the firebox 22. The spillage of air through the duct 62 may be felt at the aperture 66, indicating that the flue 46 is being subjected to downdraft. If this condition persists, the burner 28 may be switched off and the cause for the downdraft investigated. At any time, however, it is possible to verify that a satisfactory updraft exists in the flue 46 simply by monitoring the flow of air through the aperture 66. At the same time, however, the aperture 66 does not have to accomodate the full volume of air necessary for a satisfactory updraft as this is provided through the opening 72. Moreover, the baffle 74 is effective to inhibit downdrafts into the combustion chamber and at the same time split flow between the forwardly directed duct 62 and the downwardly directed opening 72.

We claim:

1. A fireplace having a housing including a combustion chamber having a front face to be directed into a room, a base, a top spaced from said base, a pair of side walls extending between said top and said base at opposite edges thereof and a rear wall extending between said side walls and said top and base at a location spaced from said front face, an exhaust duct extending from said combustion chamber at a location adjacent to the intersection of said top and rear wall to allow egress of combustion products from said combustion chamber and terminating at a manifold positioned outside said combustion chamber and operable to connect said chamber to a flue, said manifold having an exhaust outlet to direct combustion products into said flue, a baffle extending across said exhaust outlet and spaced form both said outlet and said exhaust duct to prevent direct passage of combustion products form said exhaust duct to said flue, said manifold further including a pair of inlets to supply dilution air to said flue, one of said inlets being connected to an aperture provided in said front face to receive dilution air therefrom and the other of said inlets receiving balance air from a location remote from said front face.

2. A fireplace according to claim 1 wherein said other of said inlets receives dilution air from a location lower than said aperture.

3. A fireplace according to claim 2 wherein said one inlet is defined by an inlet duct extending along said housing to said aperture.

4. A fireplace according to claim 1 wherein said baffle includes a pair of oppositely inclined surfaces converging toward an apex directed toward said flue.

5. A fireplace according to claim 4 wherein said exhaust duct terminates in said manifold on the opposite side of said pair of oppositely inclined surfaces to said flue.

6. A fireplace according to claim 4 wherein said exhaust outlet is located intermediate said inlets and said oppositely directed surfaces direct air flowing down said flue toward both of said inlets.

7. A fireplace according to claim 6 wherein said other outlet is located adjacent the rear of said housing.

8. A fireplace according to claim 7 wherein said other outlet is located at a position that, in use, is lower than said aperture in said front face.

9. A fireplace according to claim 1 wherein said exhaust duct is provided by at least one aperture in said rear wall.

10. A fireplace according to claim 1 wherein said manifold extends across the intersection of a top and rear wall of said housing.

11. A fireplace according to claim 10 wherein said manifold includes a top panel extending parallel to and spaced from said top of said housing, a rear panel extending parallel to and spaced from said rear wall of said housing and a pair of end panels at opposite ends of said top panel and rear panel and extending between the top and rear wall of said housing and said top panel and rear panel, said other inlet being located between a lower edge of said rear panel and said rear wall.

12. A fireplace according to claim 12 wherein said inlet includes an inlet duct extending from a front edge of said top panel to said aperture. rear panel, said other inlet being located between a lower edge of said rear panel and said rear wall.

13. A fireplace according to claim 12 wherein said exhaust outlet is formed in said top panel.

14. A fireplace according to claim 13 wherein said exhaust duct includes a secondary heat exchanger located between said combustion chamber and said manifold.

15. A fireplace according to claim 14 wherein said housing is formed with an outer box spaced from said combustion chamber and said heat exchanger is located between said combustion chamber and said outer box.

16. A fireplace according to claim 15 wherein said outer box has a slot formed therein to communicate with said heat exchanger and said manifold extends across said slot.

17. A fireplace according to claim 16 wherein said baffle includes a pair of oppositely inclined surfaces directed toward said outlet.

18. A fireplace according to claim 17 wherein said slot is located beneath said inclined surfaces of said baffle.

19. A fireplace according to claim 11 wherein said aperture is formed in a flange extending upwardly from the front edge of said top.

20. A fireplace according to claim 19 wherein said top forms one wall of said inlet duct.

21. A fireplace according to claim 11 wherein said inlet duct extends along said top from said front edge of said top panel of said manifold to said front face.

22. A fireplace according to claim 21 wherein said duct has a peripheral wall formed in first and second portions, said first portion being defined by said top of said combustion chamber and said second portion being detachably secured thereto.

23. A fireplace according to claim 23 wherein said second portion of said inlet duct is secured to said first portion by relative sliding motion therebetween.

24. A fireplace according to claim 23 wherein said second portion includes a pair of oppositely directed flanges engageable with complementary brackets secured to said top.

25. A fireplace according to claim 24 wherein said manifold includes a pair of laterally extending flanges engageable with complementary brackets secured to said top.

26. A fireplace having a housing including a combustion chamber with a front face to be directed into a room, an exhaust duct extending from said combustion chamber at a location remote from said front face to allow egress of combustion products from said combustion chamber and terminating at a manifold positioned outside said combustion chamber and operable to connect said chamber to a flue, said manifold having an exhaust outlet to direct combustion products into said flue, a baffle extending across said exhaust outlet and spaced from both said outlet and said exhaust duct to prevent direct passage of combustion products from said exhaust duct to said flue, said baffle including a pair of oppositely inclined surfaces converging toward an apex directed toward said flue, said manifold further including a pair of inlets to supply dilution air to said flue, one of said inlets being connected by an inlet duct extending along said housing to an aperture provided in said front face to receive dilution air therefrom and the other of inlets receiving balance air from a location remote from said front face.

27. A fireplace according to claim 26 wherein said other of said inlets receives dilution air from a location lower than said aperture.

28. A fireplace according to claim 27 wherein said exhaust duct terminates in said manifold beneath said pair of oppositely inclined surfaces.

29. A fireplace according to claim 27 wherein said exhaust outlet is located intermediate said inlets and said oppositely directed surfaces direct air flowing down said flue toward both of said inlets.

30. A fireplace according to claim 29 wherein said other outlet is located adjacent the rear of said housing.

31. A fireplace according to claim 26 wherein said combustion chamber has a base, a top spaced from said base, a pair of side walls extending between said top and said base at opposite edges thereof and a rear wall extending between said side walls and said top and base at a location spaced from said front face and said exhaust duct is located adjacent to the intersection of said top and rear wall.

32. A fireplace according to claim 31 wherein said exhaust duct is provided by a least one aperture in said rear wall.

33. A fireplace according to claim 31 wherein said manifold extends across the intersection of a top and rear wall of said housing.

34. A fireplace according to claim 33 wherein said manifold includes a top panel extending parallel to and spaced from said top of said housing, a rear panel extending parallel to and spaced from said rear wall of said housing and a pair of end panels at opposite ends of said top panel and rear panel and extending between the top and rear wall of said housing and said top panel and rear panel, said other inlet being located between a lower edge of said rear panel and said rear wall.

35. A fireplace according to claim 34 wherein said exhaust outlet is formed in said top panel.

36. A fireplace according to claim 35 wherein said exhaust duct includes a secondary heat exchanger located between said combustion chamber and said manifold.

37. A fireplace according to claim 36 wherein said housing is formed with an outer box spaced from said combustion chamber and said heat exchanger is located between said combustion chamber and said outer box.

38. A fireplace according to claim 37 wherein said outer box has a slot formed therein to communicate with said heat exchanger and said manifold extends across said slot.

39. A fireplace according to claim 38 wherein said slot is located beneath said inclined surfaces of said baffle.

40. A fireplace according to claim 34 wherein said aperture is formed in a flange extending upwardly from the front edge of said top.

41. A fireplace according to claim 40 wherein said top forms one wall of said inlet duct.

42. A fireplace according to claim 41 wherein said inlet duct has a peripheral wall formed in first and second portions, said first portion being defined by said top of said combustion chamber and said second portion being detachably secured thereto.

43. A fireplace according to claim 42 wherein said second portion of said inlet duct is secured to said first portion by relative sliding motion therebetween.

44. A fireplace according to claim 43 wherein said second portion includes a pair of oppositely directed flanges engageable with complementary brackets secured to said top.

45. A fireplace according to claim 44 wherein said manifold includes a pair of laterally extending flanges engageable with complementary brackets secured to said top.

46. A fireplace installation comprising a firebox having a front opening and a chimney spaced rearwardly of said opening and a fireplace insert located within said firebox and having a housing including a combustion chamber with a front face to be directed into a room and overlapping said front opening, an exhaust duct extending from said combustion chamber at a location remote from said front face to allow egress of combustion products from said combustion chamber and terminating at a manifold positioned outside said combustion chamber and operable to connect said chamber to a flue connection to said chimney, said manifold having an exhaust outlet to direct combustion products into said flue, a baffle extending across said exhaust outlet and spaced from both said outlet and said exhaust duct to prevent direct passage of combustion products form said exhaust duct to said flue, said manifold further including a pair of inlets to supply dilution air to said flue, one of said inlets being connected to an aperture provided in said front face to receive dilution air therefrom and the other of said inlets receiving balance air from a location remote from said front face and within said firebox.

47. A fireplace according to claim 46 wherein said other of said inlets receives dilution air from a location lower than said aperture.

48. A fireplace according to claim 47 wherein said one inlet is connected to said aperture by an inlet duct extending along said housing.

49. A fireplace according to claim 48 wherein said baffle includes a pair of oppositely inclined surfaces converging toward an apex directed toward said flue.

50. A fireplace according to claim 49 wherein said manifold is detachably secured to said combustion chamber.

51. A fireplace according to claim 50 wherein said manifold is slidably received on said combustion chamber and said inlet duct is releasably secured to said front face upon installation.

52. A fireplace according to claim 51 wherein said inlet duct has a peripheral wall formed in first and second portions, said first portion being defined by a top of said combustion chamber and said second portion being detachably secured to said combustion chamber.

53. A fireplace according to claim 52 wherein said second portion of said inlet duct is secured to said first portion by relative sliding motion therebetween.

54. A fireplace according to claim 53 wherein said second portion includes a pair of oppositely directed flanges engageable with complementary brackets secured to said top.

55. A fireplace according to claim 54 wherein said manifold includes a pair of laterally extending flanges engageable with complementary brackets secured to said top.

* * * * *